US007905241B2

(12) United States Patent
DeVries et al.

(10) Patent No.: US 7,905,241 B2
(45) Date of Patent: Mar. 15, 2011

(54) SYSTEMS AND METHODS FOR AN ANTENNA HUB TARP

(75) Inventors: James David DeVries, Gilbert, AZ (US); Gerald B. Schmidt, New Braunfels, TX (US); Geoffrey Shaffer, Canyon Lake, TX (US); Aubrey Zwicke, Seguin, TX (US); Mark Foytik, New Braunfels, TX (US)

(73) Assignee: EchoStar Technologies L.L.C., Englewood, CO (US)

( * ) Notice: Subject to any disclaimer, the term of this patent is extended or adjusted under 35 U.S.C. 154(b) by 119 days.

(21) Appl. No.: 12/333,748

(22) Filed: Dec. 12, 2008

(65) Prior Publication Data

US 2010/0147343 A1 Jun. 17, 2010

(51) Int. Cl.
*E04H 15/02* (2006.01)

(52) U.S. Cl. ..... 135/90; 135/96; 135/900

(58) Field of Classification Search ..... 135/90, 135/117, 119, 900; 160/327, 328
See application file for complete search history.

(56) References Cited

U.S. PATENT DOCUMENTS

| | | | | | |
|---|---|---|---|---|---|
| 1,741,424 | A | * | 12/1929 | Lundstrom | 135/88.13 |
| 2,315,680 | A | * | 4/1943 | Ward | 135/88.05 |
| 2,670,504 | A | * | 3/1954 | Peterson | 52/71 |
| 3,084,703 | A | * | 4/1963 | Lefebvre et al. | 135/91 |
| 3,720,438 | A | * | 3/1973 | Johnson et al. | 135/88.1 |
| 4,768,317 | A | * | 9/1988 | Markham | 52/74 |
| 5,170,811 | A | * | 12/1992 | Kirk et al. | 135/88.11 |
| 5,437,298 | A | * | 8/1995 | Lin | 135/117 |
| 6,145,525 | A | * | 11/2000 | Mooney | 135/119 |

* cited by examiner

*Primary Examiner* — David Dunn
*Assistant Examiner* — Noah Chandler Hawk
(74) *Attorney, Agent, or Firm* — Black Lowe & Graham PLLC

(57) ABSTRACT

Systems and methods of protecting service personnel and electronics in an antenna hub from inclement weather are disclosed. An exemplary embodiment of an antenna hub shelter has an attachment member secured to a hub, wherein the attachment member is located above an access door of the hub and a top portion defined by a first edge and a second opposing edge. The first edge is attachable to the attachment member. The second edge is secured to a handrail of an access platform of the antenna.

10 Claims, 4 Drawing Sheets

SYSTEMS AND METHODS FOR AN ANTENNA HUB TARP

BACKGROUND

Relatively large antennas are used to transmit and receive signals between a ground station and a satellite. As electronic circuits and components become increasingly smaller and more rugged, they are being mounted in an enclosure, or antenna hub, located at the back of the antenna. However, the electronic circuits and components require maintenance from time to time. Access is provided through an enclosure access door or the like. Thus, the electronic circuits and components are protected from the weather when the access door is closed.

From time to time, access to the electronic circuits and components in the enclosure is required. When weather conditions are favorable, access to the electronic circuits and components via the access door is easy and convenient. The service person(s) simply climb up the stairs or a ladder to a service platform that is in proximity to the access door. Once the access door is open, the service person(s) have access to the electronic circuits and components of the antenna.

However, during inclement weather, such as snow, rain, hail or the like, there is a risk that potentially damaging moisture, in the form of rain, snow or fog, may enter through the access door and cause damage to the electronic circuits and components when the access door is open. In many situations, it is not possible for the service person(s) to wait for the passing of the inclement weather. Rather, access to the electronic circuits and components is required immediately.

One solution is to build protective enclosures that protect both the service person(s) and the electronic circuits and components. There are difficulties in building an enclosure that is large enough to shelter the service person(s). For example, since the antenna is typically configured to be moved about to point in different directions, an enclosure that is sufficiently large to accommodate the service person(s) may have to be attached to the moving structure of the antenna dish. Alternatively, the enclosure must be large enough to accommodate independent movement of the antenna dish. Such enclosures, which may not be often used by service personnel, is expensive to install, operate and/or maintain.

SUMMARY

Systems and methods of protecting service personnel and electronics in an antenna hub from inclement weather are disclosed. An exemplary embodiment of an antenna hub shelter has an attachment member secured to a hub, wherein the attachment member is located above an access door of the hub and a top portion defined by a first edge and a second opposing edge. The first edge is attachable to the attachment member. The second edge is secured to a handrail of an access platform of the antenna.

BRIEF DESCRIPTION OF THE DRAWINGS

Preferred and alternative embodiments are described in detail below with reference to the following drawings.

DETAILED DESCRIPTION

Figure 1:
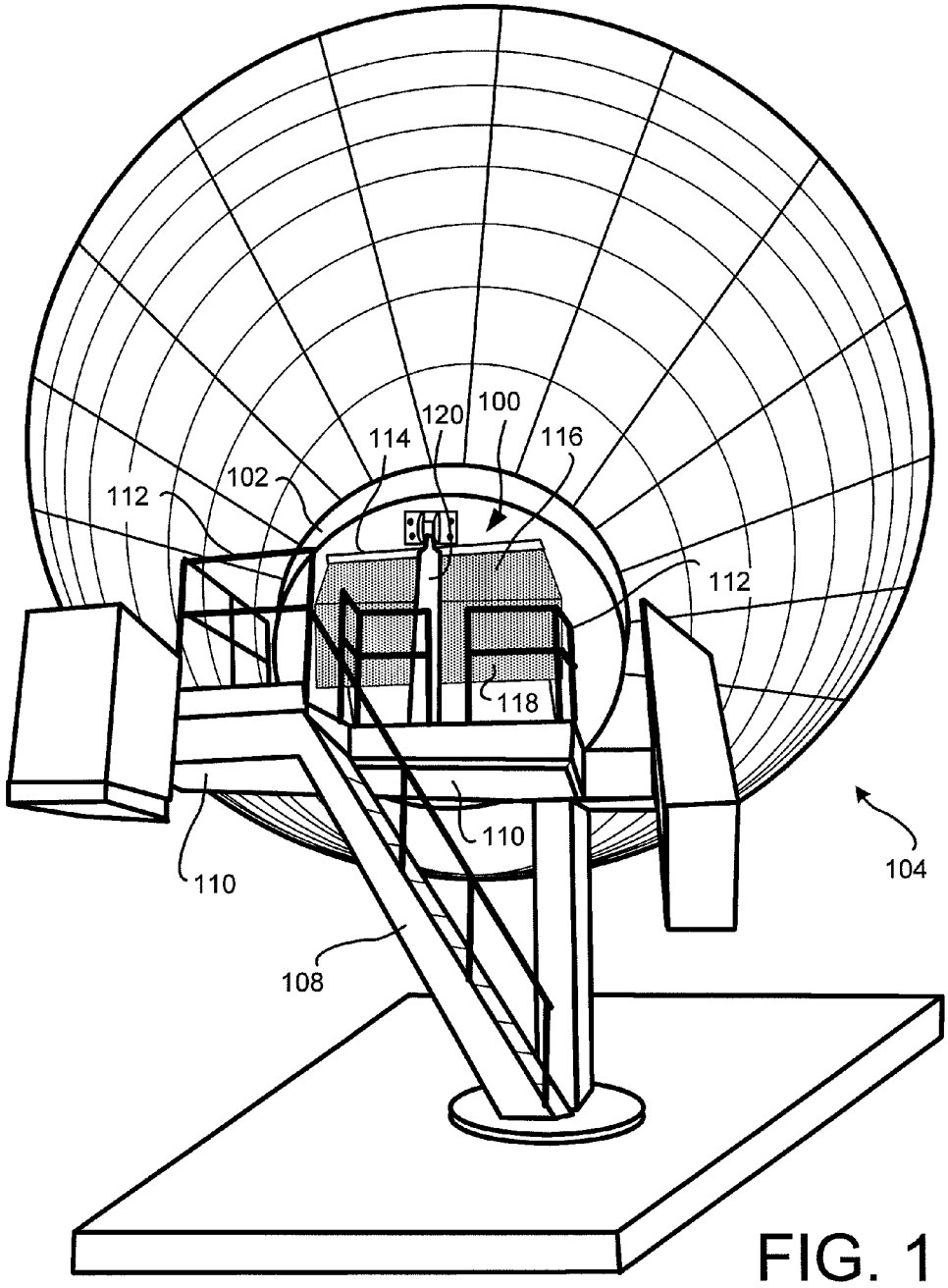
FIG. 1 is a perspective view an embodiment of a portable antenna hub shelter attached to a hub of an antenna.
Figure 2:
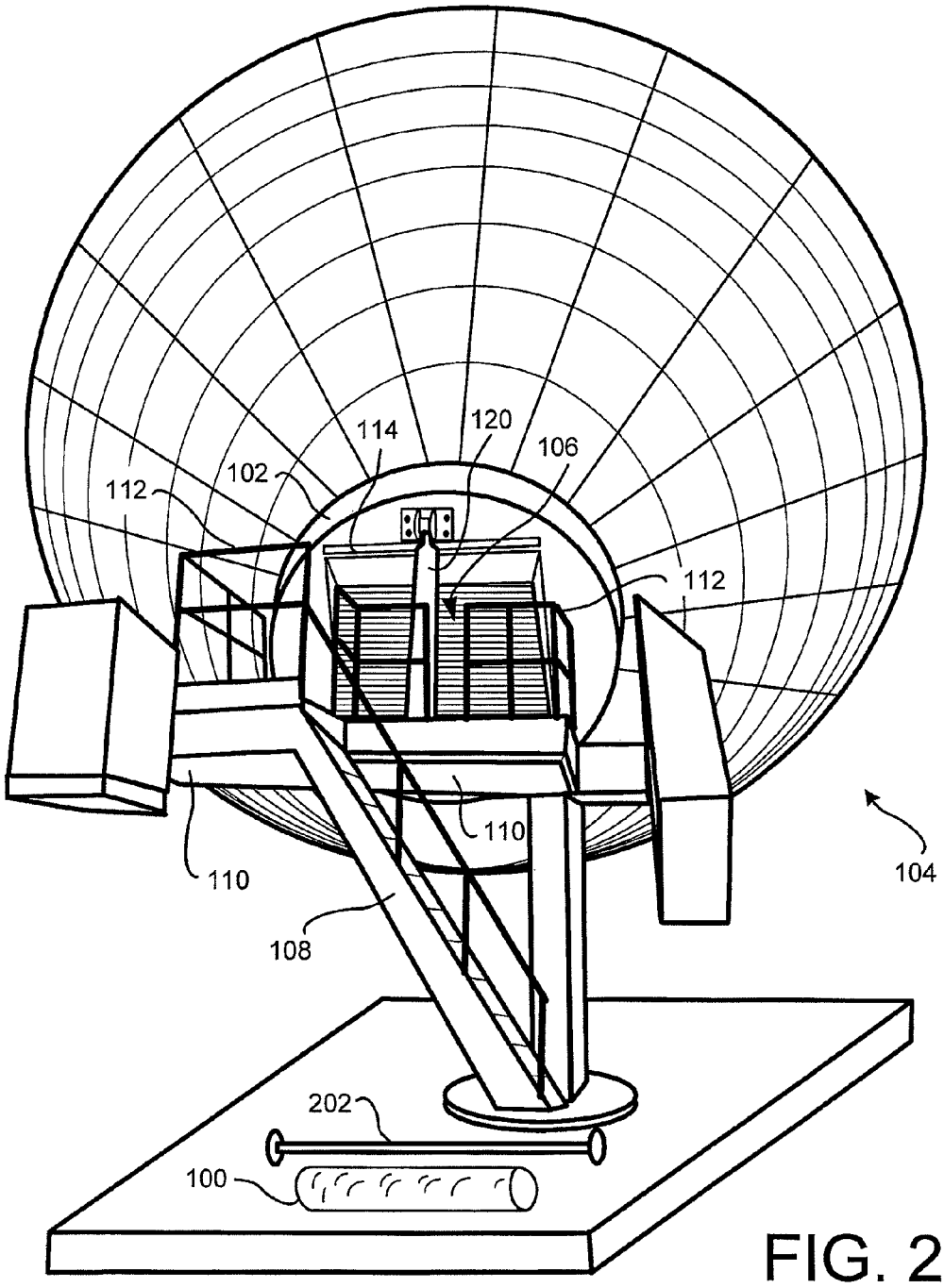
FIG. 2 is a perspective view of an embodiment of a packaged portable antenna hub shelter.

FIG. 1 is a perspective view an embodiment of a portable antenna hub shelter 100 attached to a hub 102 of an antenna 104. FIG. 2 is a perspective view of an embodiment of a packaged portable antenna hub shelter.

Inclement weather poses a safety hazard to service personnel when working on electronic circuits and components residing in the hub 102. The electronic circuits and components are accessed by opening the access door 106 located on the backside of the hub 102. Further, the inclement weather may potentially damage the sensitive electronic circuits and components when they are being worked on. Embodiments of the portable antenna hub shelter 100 solve this problem by providing a temporary shelter to the service personnel and to the exposed electronic circuits and components. Since a permanent shelter is not required to protect the service personnel and/or the electronic circuits and components, the construction, maintenance and operating costs are reduced since the antenna hub shelter 100 provides temporary shelter to the service personnel and to the electronic circuits and components when the access door 106 is opened (FIG. 2).

The antenna 104 has a relatively large antenna dish. For example, but not limited to, diameters of an antenna dish may be 9 meters or 13 meters. One or more service persons may access electronic equipment in the hub 102 by climbing the stairs 108 and standing on the access platform 110. Handrails 112 are provided for safety.

In one embodiment, the portable antenna hub shelter 100 is configured to attach to the an attachment member 114 that has been affixed to the hub 102 above the access door 106. The attachment member 114 may be any suitable structure, or structures, configured to physically couple with and secure an edge of a top portion 116 of the portable antenna hub shelter 100 to the hub 102. Non-limiting examples of the attachment member 114 include a cut-to-length piece of metal, such as, but not limited to, a length of angle iron. For example, the attachment member 114 may include a plurality of holes located along its length configured to receive hooks or the like. The hooks or the like are attached to the edge of the top portion 116 of the portable antenna hub shelter 100 and located at positions corresponding to the holes in the attachment member 114.

In some embodiments, an opposing edge of the top portion 116 of the portable antenna hub shelter 100 is configured to attach to the handrails 112. Thus, when the top portion 116 is extended between the hub 102 and the handrails 112, the top portion 116 provides a shelter from the weather to the service personnel and the electronic equipment in the hub 102.

In some embodiments, a weather skirt 118 of the portable antenna hub shelter 100, extends downward from the handrails 112 to provide further protection from the weather. The weather skirt 118 may be attached to the top portion 116 of the portable antenna hub shelter 100 using any suitable means, such as by sewing, snaps, zippers, hook and loop fabric fasteners (e.g.; Velcro®), or the like. In some embodiments, the portable antenna hub shelter 100 is made of a single piece of fabric or plastic with the weather skirt 118 and the top portion 116 separated by a fold or bend.

The top portion 116 and the optional weather skirt 118 of the portable antenna hub shelter 100 may be made of any suitable material. In some embodiments, the top portion 116 and the weather skirt 118 are made of a suitable material such as canvass, cloth, flexible plastic, or the like. In other embodiments, the top portion 116 and the weather skirt 118 may be made of rigid plastic or metal. If the top portion 116 and the weather skirt 118 are separate, they may be made of different materials. For example, the weather skirt 118 may be made of a rigid or semi-rigid plastic and attached to a canvass top portion 116 using hook and loop fabric fasteners.

An optional support member 202 (FIG. 2), such as a relatively long piece of metal, wood, or plastic, may be secured to the handrails 112 or the access platform 110 to secure the top portion 116. For example, an elevation jack 120 or other device may be positioned between the hub 102 and the handrails 112, thus making it difficult to affix the edge 314 to the handrails 112.

Figure 3:
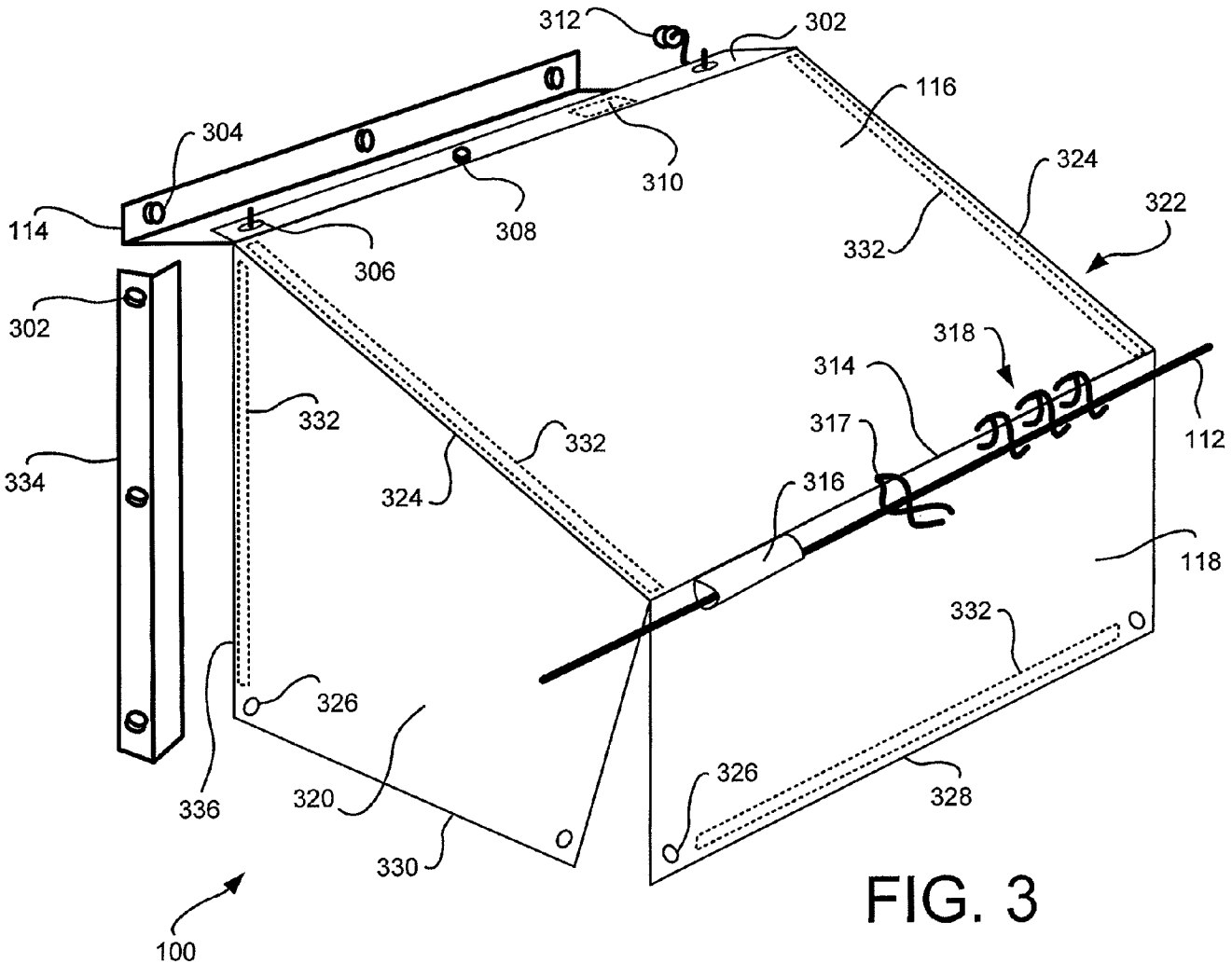
FIG. 3 is a perspective view of an embodiment of the portable antenna hub shelter 100 deployed on the hub 102.

FIG. 3 is a perspective view of an embodiment of the portable antenna hub shelter 100 deployed by coupling to edge 302 of the top portion 116 to the attachment member 114. The attachment member 114 is attached to the hub 102 (not shown). Here, the attachment member 114 is illustrated as an L-shaped piece of angle metal or the like with a first edge that is affixed to the hub 102 via a plurality of bolts 304. Alternatively, or additionally, the attachment member 114 may be affixed to the hub 102 using any suitable method or apparatus, such as, but not limited to, screws, nuts, adhesives, or the like.

The edge 302 of the top portion 116 may be secured to the attachment member 114 using any suitable attachment device. For example, but not limited to, a pin 306, a snap 308, or the hook and loop fabric fastener 310 may be used to secure the edge 302 of the top portion 116 to the hub 102.

Alternatively, a small attachment device, such as the illustrated hook 312, or alternatively a hook ring, may be affixed to the hub 102. The attachment device may be used to secure the edge 302 of the top portion 116 to the hub 102. Other embodiments may employ snaps, hook and loop fabric fastener tabs, pins, buttons or the like to secure the edge 302 of the top portion 116 to the hub 102.

An edge 314, opposing to the edge 302, is secured to the handrail 112. Alternatively, the opposing edge 314 may be is secured to support member 202 (FIG. 2).

In some embodiments, a length of looped fabric 316 may be used to couple the edge 314 to the handrail 112. In such embodiments, the fabric 316 may be affixed to the edge 314 along one edge such that the fabric 316 may be looped around the handrail 112. Snaps, hook and loop fabric fastener tabs, pins, buttons or the like may be used to secure the opposing side of the fabric to secure the edge 314 of the top portion 116 to the handrail 112. Or, the ties or ropes 317 may be secured to the edge 324 and tied together around the handrail 112. Alternatively, or additionally, hooks 318 or the like may be used to secure the edge 314 of the top portion 116 to the handrail 112.

To provide additional protection from the weather, an optional weather skirt 118 may hang downwardly from the handrail 112. In other embodiments, an optional first side weather skirt 320 and an optional second side weather skirt 322 (hidden from view) may hang down from the side edges 324 of the top portion 116. The side weather skirts 320, 322 may be attached to the top portion 116 of the portable antenna hub shelter 100 using any suitable means, such as by sewing, snaps, zippers, hook and loop fabric fastener, or the like. In some embodiments, the portable antenna hub shelter 100 is a single piece with the side weather skirts 320, 322 and the top portion 116 separated by a fold or bend at edge 324.

In some embodiments, apertures 326 along the edge 328 of the weather skirt 118 and the edge 330 of the side weather skirts 320, 322 are provided to secure the edges 328, 330. Apertures 326 may be holes, grommets, or the like. For example, bungee cords, ropes, clamps, or the like may be used to secure the weather skirt 118 and the side weather skirts 320, 322 to other handrails, to the access platform 110, weights, or to another structure.

In some embodiments, supporting structures 332 are used to provide additional support and rigidity to the deployed portable antenna hub shelter 100. The supporting structures 332 may be detachable from the portable antenna hub shelter 100, or may be affixed to the material of the portable antenna hub shelter 100. Further, the ends of the supporting structures 332 may be configured to attach to the handrails 112 and/or the access platform 110. In some embodiments, a plurality of supporting structures 332 are configured to be assembled into a frame, wherein the portable antenna hub shelter 100 is stretched over the frame.

In some embodiments, supplemental attachment members 334 may be used to secure the edges 336 of the weather skirts 320, 322 to the hub 102. The edges 336 of the weather skirts 320, 322 may be affixed to the supplemental attachment members 334 using any of the above described means.

Figure 4:
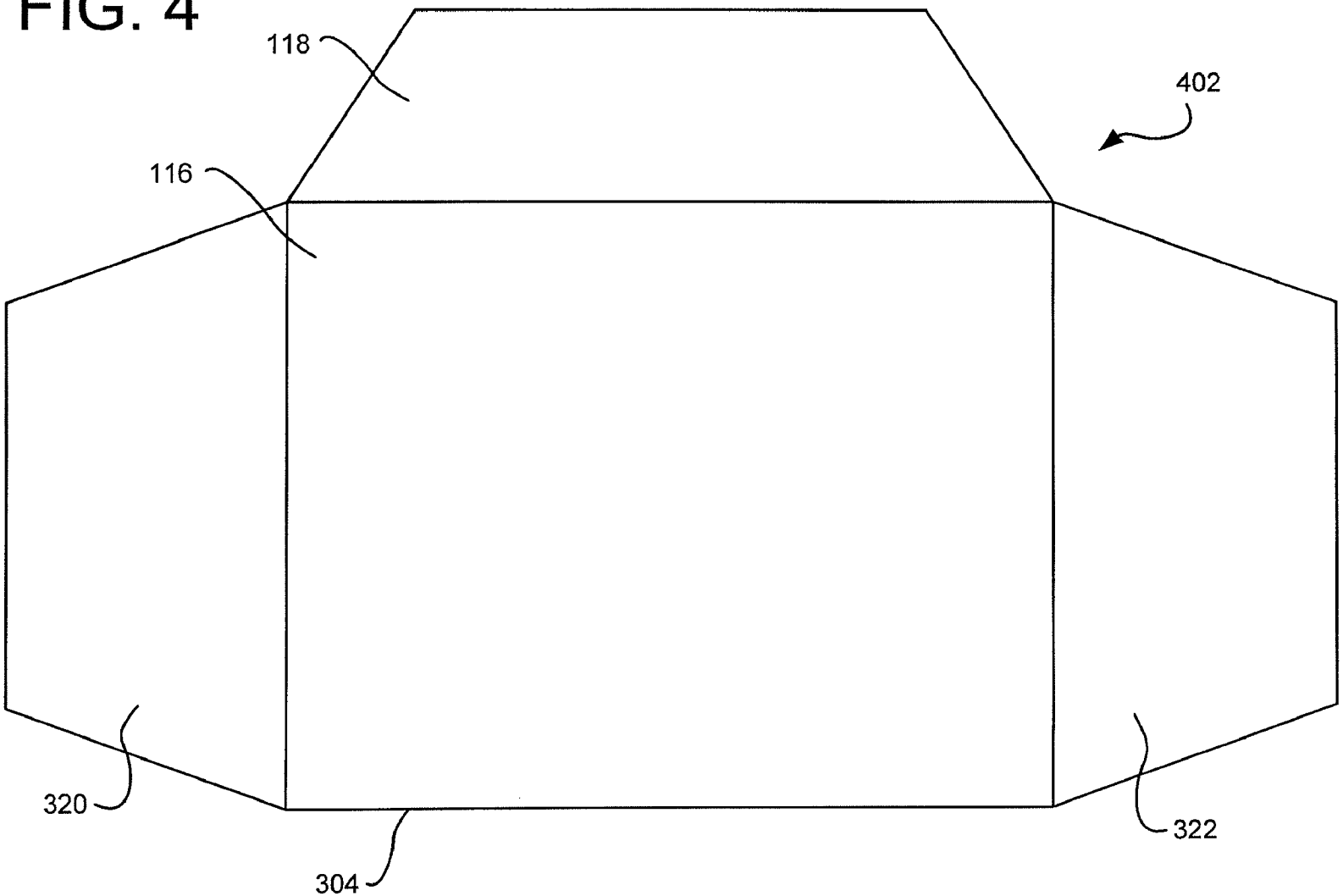
FIG. 4 illustrates a pattern for the material used to make an exemplary portable antenna hub shelter.

FIG. 4 illustrates an exemplary material pattern 402 for the material used to make an exemplary portable antenna hub shelter 100. The pattern includes the top portion 116, the optional weather skirt 118, and the optional weather skirts 320, 322. It is appreciated that any suitable material pattern 402 may be used depending upon the size and dimensions of the work area that is to be sheltered by embodiments of the portable antenna hub shelter 100. During manufacture, the material pattern 402 may be used to cut a single piece of material. Or, portions of the material pattern 402 may be used to separately cut separated portions of material, which are then later sewn together or otherwise attached to a unitary body of material. Or, the individual pieces of material may be kept separate for later attachment (using snaps, zippers, buttons, pins, hook and loop fabric fasteners or the like) when the portable antenna hub shelter 100 is affixed to the hub 102.

It should be emphasized that the above-described embodiments of the portable antenna hub shelter 100 are merely possible examples of implementations of the invention. Many variations and modifications may be made to the above-described embodiments. All such modifications and variations are intended to be included herein within the scope of this disclosure and protected by the following claims.

The embodiments of the invention in which an exclusive property or privilege is claimed are defined as follows:

1. A system comprising:

an antenna hub configured to support at least one satellite antenna mounted thereon, the antenna hub comprising:

an access platform configured to support one or more service persons;

an access door configured to provide access to electronics residing in the antenna hub; and a handrail secured to the access platform; and an antenna hub shelter attached to the antenna hub, the shelter, comprising:

an attachment member secured to the antenna hub, wherein the attachment member is located above the access door of the antenna hub; and a top portion defined by a first edge and a second opposing edge, wherein the first edge is configured to attach to the attachment member, and wherein the second edge is secured to the handrail of the access platform.

2. The system of claim 1, wherein the first edge is configured to be secured to the attachment member with at least one selected from a group consisting of a zipper, a plurality of buttons, a plurality of snaps, a plurality of hooks, and a strip of a hook and loop fabric fastener.

3. The system of claim 1, further comprising:

a weather skirt configured to extend downwardly from the second edge of the top portion.

4. The system of claim 3, wherein the weather skirt is configured to be secured to the second edge of the top portion with at least one selected from a group consisting of a zipper, a plurality of buttons, a plurality of snaps, a plurality of hooks, and a strip of a hook and loop fabric fastener.

5. The system of claim 3, wherein the top portion and the weather skirt are formed of a single piece of material, and wherein the top portion and the weather skirt are joined at a fold.

6. The system of claim 1, further comprising:

a first side weather skirt configured to extend downwardly from a first side edge of the top portion of the antenna hub shelter; and a second side weather skirt configured to extend downwardly from a second side edge of the top portion of the antenna hub shelter.

7. The system of claim 1, wherein the attachment member comprises a length of metal extending at least a length of the access door of the antenna hub.

8. The shelter system of claim 7, wherein the attachment member comprises a length of angle metal extending at least the length of the access door of the antenna hub, wherein a first side of the angle metal is affixed to the antenna hub, and wherein a second side of the angle metal comprises:

an attachment device that is configured to secure the edge of the top portion to the second side of the angle metal.

9. The shelter system of claim 8, wherein the attachment device consists of at least one selected from a group consisting of a zipper, a plurality of buttons, a plurality of snaps, a plurality of hooks, and a strip of a hook and loop fabric fastener.

10. The system of claim 1, further comprising:

a support member, wherein the second edge of the top portion of the antenna hub shelter is secured to the support member, and wherein the support member is secured to the handrail of the access platform.

* * * * *